US007635840B2

(12) United States Patent
Jindai et al.

(10) Patent No.: US 7,635,840 B2
(45) Date of Patent: Dec. 22, 2009

(54) SURFACE ANALYSIS APPARATUS AND METHOD USING ION BOMBARDMENT

(75) Inventors: Kazuhiro Jindai, Yokohama (JP); Hideto Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 11/819,200

(22) Filed: Jun. 26, 2007

(65) Prior Publication Data

US 2008/0001081 A1 Jan. 3, 2008

(30) Foreign Application Priority Data

Jun. 29, 2006 (JP) ..... 2006-179815
Apr. 16, 2007 (JP) ..... 2007-107173

(51) Int. Cl.
*H01J 49/40* (2006.01)

(52) U.S. Cl. ..... 250/287; 250/281; 250/282; 250/285; 702/27; 702/28

(58) Field of Classification Search ..... 250/287, 250/281, 282, 283, 284, 288, 286, 285; 702/19, 702/23, 24, 25, 26, 27, 28, 29, 30, 32
See application file for complete search history.

(56) References Cited

U.S. PATENT DOCUMENTS 7,078,687 B2 7/2006 Uenishi et al. ..... 250/306
7,411,192 B2 * 8/2008 Takeuchi et al. ..... 250/311
2001/0020515 A1 9/2001 Shibata et al. ..... 156/329
2004/0036032 A1 * 2/2004 Leung et al. ..... 250/423 R
2005/0194536 A1 * 9/2005 Furiki et al. ..... 250/311
2006/0255263 A1 * 11/2006 Ishimaru et al. ..... 250/288
2007/0075239 A1 * 4/2007 Ding et al. ..... 250/282
2007/0138385 A1 * 6/2007 Kulp et al. ..... 250/282
2007/0187588 A1 * 8/2007 Yoshinari et al. ..... 250/288

FOREIGN PATENT DOCUMENTS

JP 2001-240820 9/2001
JP 2004-219261 8/2004

OTHER PUBLICATIONS

Winograd et al., "Surface sensitivity in cluster-ion-induced sputtering", The American Physical Society, Jun. 2, 2006, pp. 1 to 3.
S.R. Bryan, et al., "Analysis of Thin Organic Films using Gold Cluster and $C_{60}$ Ion Beams", Physical Electronics, 19$^{th}$ Annual SIMS Workshop, May 2006, 23 pgs.

* cited by examiner

*Primary Examiner*—Jack I Berman
*Assistant Examiner*—Nicole Ippolito Rausch
(74) *Attorney, Agent, or Firm*—Fitzpatrick, Cella, Harper & Scinto

(57) ABSTRACT

A surface analysis apparatus includes a unit configured to bombard a sample surface with at least two types of ions having different sizes; a measurement device for measuring, with a time-of-flight secondary ion mass spectrometer, a mass spectrum of ions emitted from the sample surface; and an information processor outputting a difference between two mass spectra measured by bombardment of different types of ions.

12 Claims, 6 Drawing Sheets

CLUSTER ION BOMBARDMENT

MONOMER ION BOMBARDMENT

CONTAMINATION OF SPUTTERED SURFACE
( f ( FIG. 4A - FIG. 4B ) )

SURFACE ANALYSIS APPARATUS AND METHOD USING ION BOMBARDMENT

BACKGROUND OF THE INVENTION

1. Field of the Invention

The present invention relates to surface structural analysis of materials and structures and structural analysis in a depth direction from surfaces. Particularly, the present invention relates to a structural analysis method using cluster ion bombardment and a measuring apparatus therefor.

2. Description of the Related Art

As a surface analysis method and apparatus, a generally used method of analyzing surface structures uses a photoelectron spectrometer, an X-ray microanalyzer, an Auger electron spectrometer, or a time-of-flight secondary ion mass spectrometer.

The time-of-flight secondary ion mass spectrometer (referred to as "TOF-SIMS" hereinafter) is an apparatus in which a sample surface is bombarded with primary ions such as Ga+, In+, or Au+ in a vacuum to ionize the constituent elements and molecules of the sample surface, and the times of flight of the emitted secondary ions are measured to obtain a mass spectrum of the constituent elements and molecules of the sample surface. Japanese Patent Laid-Open No. 2004-219261 discloses an example in which a gradient shaving surface of a thin film was analyzed by TOF-SIMS. The TOF-SIMS is advantageous in that elements and molecules of a sample surface can be detected with high sensitivity.

In order to analyze a structure in the depth direction from a surface thereof, a generally used method is to analyze the structure of an exposed surface while sputtering the surface of a sample by ion bombardment. Japanese Patent Laid-Open No. 2001-240820 discloses an example of this method.

For a ground surface, the same analysis method as described above is used. In the TOF-SIMS, the primary ion beam power for measurement is increased so that a sample can be sputtered in the depth direction by the ion bombardment. Further, sputtering and measurement are alternatively performed to obtain the depth profile data.

As the primary ions for the TOF-SIMS, cluster ions composed of two or more atoms, not ions composed of a single atom, may be used. Even when a sample surface is bombarded by cluster ions with high acceleration energy, the cluster ions stay at a shallow depth from the sample surface. And the molecules around the cluster ions impact point are ionized and emitted. Therefore, the cluster ions are very useful for TOF-SIMS analysis of an ultra-thin surface layer.

In order for a solid surface to have a water-repellent property, the solid surface is treated by forming a mono-layer using a surfactant copolymer. And the solid surface has hydrophobic groups at the outermost surface. The water-repellency of a solid surface can be estimated by measuring each atom or molecule ratio in the depth direction of an ultra-thin organic layer formed on the solid surface.

However, general sputtering ions, such as argon ions, cesium ions, gallium ions, gold ions, and bismuth ions, work not only for sputtering a surface but also for destroying an internal structure. In particular, in an organic compound mono-layer such as a mono-molecular layer used for water-repellent treatment or a mono-layer of a molecular bonding inorganic compound, the layer structure is destroyed by ion sputtering because the mono-layer has weak bonds on a solid surface.

As a method capable of sputtering an organic sample surface by sputtering without destroying the internal structure thereof, a method of sputtering a surface using fullerene ions has recently been developed. Fullerene ion sputtering apparatuses capable of being mounted on various surface analyzers are used commercially.

Further, a system for cooling a sample stage with liquid nitrogen has been used commercially. Cooling a sample can not only freeze liquid components and volatile components in the sample but also decrease damage due to fullerene ions impact. The structural analysis application of organic compounds in the depth direction by fullerene ion sputtering has been developed more.

In particular, a time-of-flight secondary ion mass spectrometer is one of the few analysis machines getting molecular structure information of molecular compounds such as organic compounds, and is the only one of the analysis machines getting molecular structure data in the depth direction with a sputtering apparatus at the present time.

By using fullerene ions to sputter an organic compound surface, the surface can be sputtered without destroying the internal structure thereof. However, the inventors have found by measurement that fullerene remains as a contamination on the sputtered sample surface.

When fullerene remains on the sputtered surface, it is impossible to distinguish between fullerene contamination data and original surface data even by a surface structure analysis using a time-of-flight secondary ion mass spectrometer, and thus analysis is very difficult.

TOF-SIMS analysis for a surface including a fullerene contamination or an organic compound surface from which the fullerene contamination has been removed has another problem. Namely, an organic compound has a complicated molecular structure, and thus the organic compound does not have a constant density in a solid state and forms a surface in which the density varies in the depth direction. Therefore, it is uncertain how deeply primary ions impact on the surface to emit secondary ions, and thus the precise analysis depth points in the surface cannot be determined. This point significantly distinguishes an organic compound surface from a clean inorganic solid surface and makes TOF-SIMS analysis for an organic compound surface more difficult.

SUMMARY OF THE INVENTION

The present invention provides an analysis apparatus and method for analyzing a layer of an organic compound or a molecular bonding compound formed on a solid surface using a time-of-flight secondary ion mass spectrometer to measure a composition profile in the depth direction from a sample outermost surface.

The present invention also provides a structural analysis method and apparatus for analyzing a structure in a depth direction by sputtering a surface using fullerene ions.

The present invention further provides a structural analysis method and apparatus capable of freezing a liquid component and a volatile component in a sample by cooling the sample with liquid nitrogen and decreasing damage due to fullerene ion impact.

In accordance with a first embodiment of the present invention, a surface analysis apparatus includes a system for bombarding a sample surface with at least two types of ions having different sizes; a measurement device for measuring, with a time-of-flight secondary ion mass spectrometer, a mass spectrum of ions emitted from the sample surface; and an information processor outputting a difference between the two mass spectra measured by bombardment with different types of ions.

In accordance with a second embodiment of the present invention, a surface analysis method includes the steps of:

A: sputtering a sample surface with fullerene ions;

B: bombarding the sample surface with at least two types of ions of different sizes;

C: measuring a mass spectrum of ions emitted from the sample surface with a time-of-flight secondary ion mass spectrometer; and D: outputting a difference between two mass spectra measured by bombardment with different types of ions;

wherein the step D is performed after the steps A to C are repeated several times. Steps A to C are repeated till the sputtered surface reaches across the layer to be analyzed.

In the above-described method and apparatus for structural analysis in the depth direction by fullerene ion sputtering, as data analysis based on the bombardment ion size, it can be analyzed that structural information of a portion constituting a predetermined layer at a depth from a surface is expressed by a difference between a plurality of items of information obtained because the larger bombardment ion size, the more the outermost surface structural information is detected with high sensitivity.

The method of structural analysis in the depth direction by fullerene ion sputtering of the present invention is capable of analyzing a molecular structure of a molecular compound in the depth direction.

The surface analysis method and apparatus of the present invention are capable of measuring a component distribution in the depth direction of a monomolecular layer of an organic compound and a molecular bonding compound formed on a solid surface.

The analysis method and apparatus of the present invention are capable of microscopically analyzing film conditions of a water-repellent treated surface or a hydrophilic-treated surface. The obtained results can be utilized for improving the selection of a coating material and a coating method, as compared with the macroscopically measured degree of water-repellency or hydrophilicity.

The method and apparatus for structural analysis in the depth direction by fullerene ion sputtering of the present invention are capable of analyzing a molecular structure of a molecular compound such as an organic compound or a silicon compound in the depth direction.

Further, when the molecular compound is sputtered by fullerene ion sputtering, ion sputtering conditions can be appropriately determined so as to minimize contamination of a sputtered surface with fullerene contamination.

It is generally known that contamination and fracture state of a sputtered surface and the sputtering rate are influenced by the sample surface temperature, the sputtering angle of an ion beam with respect to the sample surface, the ion beam density (ion current value), and the acceleration voltage of ion sputtering among the sputtering conditions for ion sputtering of a sample. The method of structural analysis in the depth direction by fullerene ion sputtering of the present invention is effective as a method of evaluating and analyzing the contamination and fracture state of a sputtered surface by appropriately changing the conditions.

Further features of the present invention will become apparent from the following description of exemplary embodiments (with reference to the attached drawings).

DESCRIPTION OF THE EMBODIMENTS

When bombardment ions impact on a sample surface to generate secondary ions in a time-of-flight secondary ion mass spectrometer, the impact ratio of the bombardment ions is influenced by the size of the bombardment ions and the density of a sample. Namely, when the size of bombardment ions is smaller than the density of the outermost surface of a sample, the impact ratio of bombardment ions on the outermost surface of the sample is decreased, and the impact ratio of bombardment ions entering the sample from the outermost surface thereof is increased. Conversely, when the size of bombardment ions is larger than the density of the outermost surface of a sample, the impact ratio of bombardment ions on the outermost surface of the sample is increased, and the impact ratio of bombardment ions entering the sample from the outermost surface thereof is decreased.

The impact ratio of bombardment ions primarily depends on the size of the bombardment ions and the density of a sample. However, the density of the surface of a sample generally tends to be lower than that of the inside of the sample, and in particular, the tendency of organic compounds and molecular compounds becomes significant. Therefore, mass spectra including information at different depths from the surface of the sample can be obtained by bombardment ions of different sizes.

Therefore, the analysis of a difference between mass spectra measured by bombardment of ions of different sizes permits the analysis of a composition profile in the depth direction from the surface of the sample.

Embodiments of the present invention will be described with reference to the drawings.

First Embodiment

Figure 1:
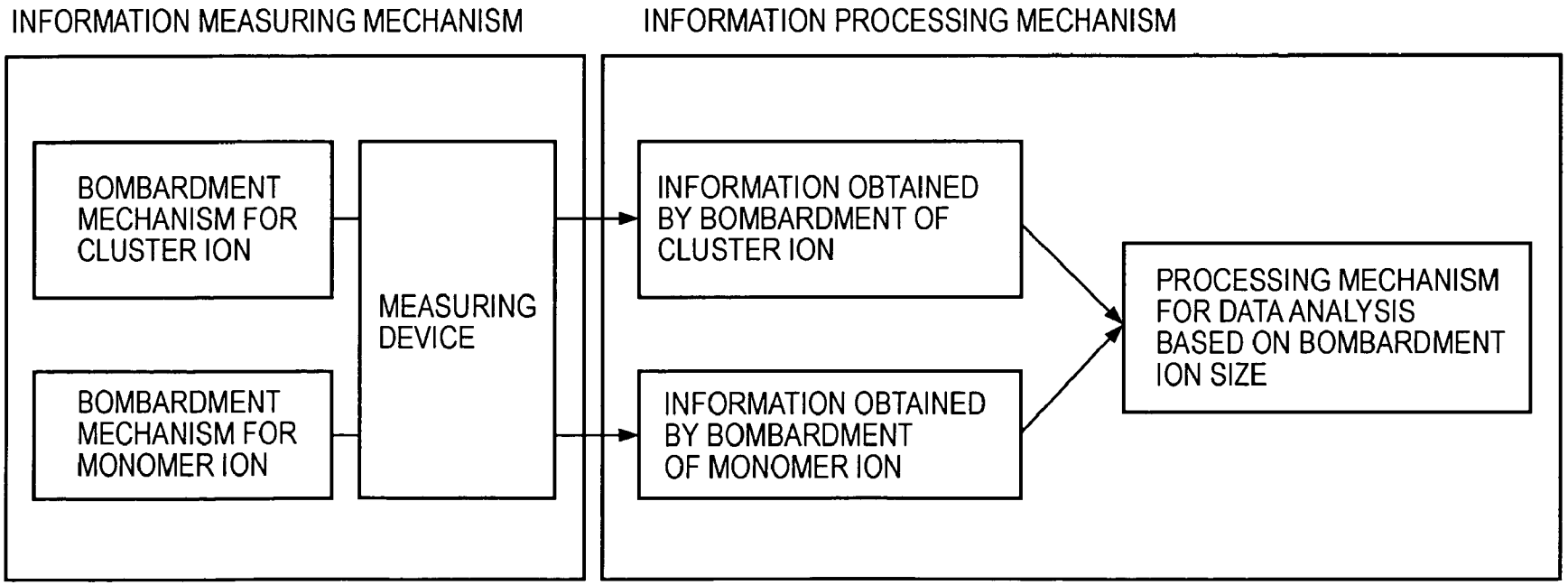
FIG. 1 is a block diagram showing the configuration of a surface structural analysis apparatus of the present invention.

FIG. 1 is a block diagram showing the configuration of a surface measuring apparatus according to a first embodiment of the present invention. The surface measuring apparatus shown in FIG. 1 includes an information measuring mechanism for measuring a sample, and an information processing mechanism for analyzing the obtained results.

Figure 2:
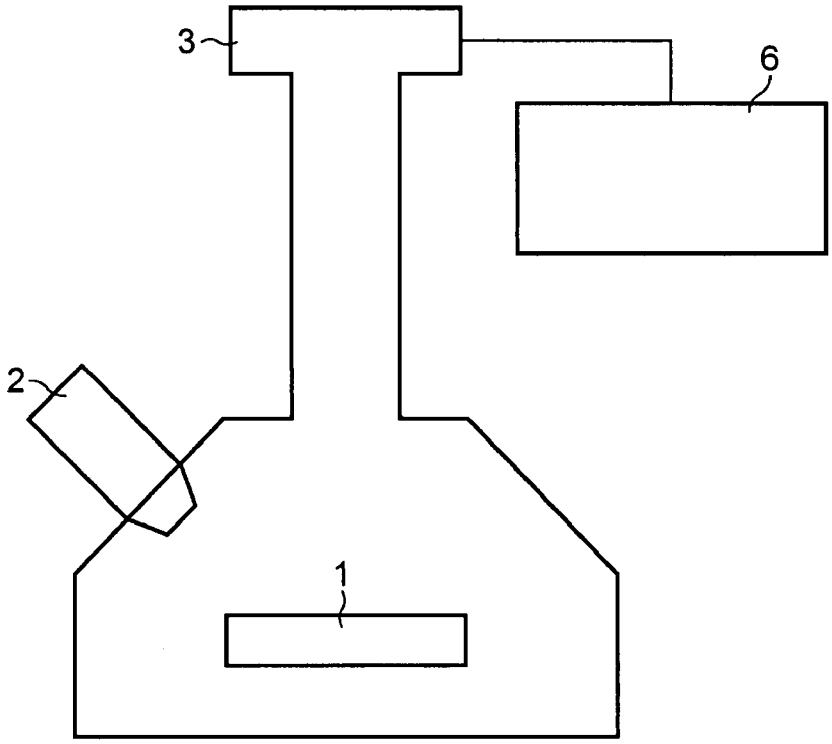
FIG. 2 is a drawing showing a surface structural analysis apparatus according to a first embodiment of the present invention.

FIG. 2 is a schematic drawing of a time-of-flight secondary ion mass spectrometer corresponding to the information measuring mechanism of the surface measuring apparatus shown in FIG. 1.

The time-of-flight secondary ion mass spectrometer shown in FIG. 2 is provided with an ion bombardment mechanism 2. The ion bombardment mechanism 2 includes a monomer ion bombardment function to bombard monomer ions and measure a mass spectrum of secondary ions, and a cluster ion bombardment function to bombard cluster ions and measure a mass spectrum of secondary ions.

The monomer ion bombardment function may include bombardment of monomers of at least two different elements.

The cluster ion bombardment function may include bombardment of a plurality of types of cluster ions, such as dimer cluster ions and trimer cluster ions.

The information processing mechanism shown in FIG. 1 corresponds to an information processor 6 connected to a measuring device 3 shown in FIG. 2. The information processor 6 receives the results of measurement by the measuring device 3, i.e., mass spectral data, and outputs the results of processing according to predetermined procedures together with the size information of the bombardment ions.

The time-of-flight secondary ion mass spectrometer shown in FIG. 2 is provided with a stage (not shown) on which a sample 1 is placed, the ion source (referred to as a "primary ion bombardment mechanism" hereinafter) 2 for bombardment by monomer ions or cluster ions, and the measuring device 3. The measuring device 3 receives secondary ions emitted from the sample 1, resolves the secondary ions according to the times of flight, and measures the intensity of the secondary ions in each resolution channel. The obtained results are output as a mass spectrum and sent to the information processor 6.

As the monomer ions, at least one element selected from gold, bismuth, gallium, and indium is used. As the cluster ions, gold or bismuth can be used.

A sample is bombarded with ions in the descending order of ion sizes, and a mass spectrum of each type of ions is measured. As described below, in analysis of the present invention, an intensity difference between two spectra is taken into consideration, and thus the amount of the secondary ions detected is kept constant so that the total intensity of a spectrum is constant regardless of the type of primary ions. When ion bombardment is repeated several times to integrate the amount of the secondary ions measured, the amount of the secondary ions may be kept constant for a total number of times of ion bombardment.

The order of bombardment of primary ions may be reversed. When a sample is significantly damaged, the sample is protected by shifting the position of ion bombardment or reducing the bombardment time.

The resultant mass spectra of at least two types of primary ions of different ion sizes are transmitted to an information processing unit for data analysis on the basis of the bombardment ion sizes.

Specifically, a difference between the mass spectra obtained by bombardment of each ion is calculated. The term "difference between mass spectra" represents a difference between intensity data in each mass channel. When intensity data of a smaller-sized ion is subtracted from intensity data of a larger-sized ion, the difference is regarded as positive.

When three or more mass spectra are transmitted, the spectra are arranged in the descending order of ion sizes, and a difference between the adjacent spectra is calculated.

In higher-order data analysis, the composition of a sample may be estimated from the resultant mass spectra. The procedures thereof will be described.

In the ion source 2 shown in FIG. 2, the acceleration voltage of primary ions is determined.

Ions of a large size impact on the outermost surface of the sample, while ions of a small size impact into the outermost surface of the sample, impact molecules of the sample at a depth from the outermost surface, and emit the molecules. Therefore, the resultant mass spectra have the elements information of the sample nearer to the outermost surface of the sample, i.e., at a shallower depth of the sample, as the ion size increases.

With respect to a difference between each spectrum of different types of ions, positive intensity indicates molecules mostly distributed at a depth near the outermost surface, and negative intensity indicates molecules mostly distributed at a depth far the outermost surface. Molecules uniformly distributed regardless of depth disappear from a differential spectrum, and thus only molecules distributed depending on the depth can be clearly distinguished. This is an advantage of the differential spectrum.

By using the above-described analysis method, a composition distribution near a surface of a water-repellent material or a hydrophilic material is determined. The degree of water repellency or hydrophilicity can also be evaluated.

Second Embodiment

Figure 3:
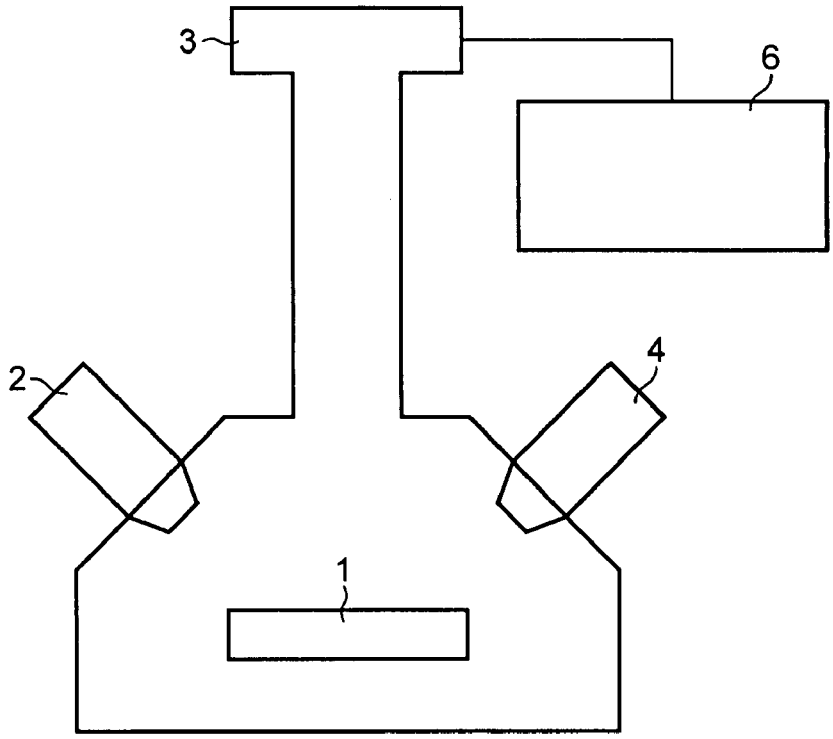
FIG. 3 is a drawing showing a surface structural analysis apparatus according to a second embodiment of the present invention.

FIG. 3 shows an apparatus for structural analysis in a depth direction by fullerene ion sputtering according to a second embodiment of the present invention.

In addition to the constitution shown in FIG. 2, the apparatus for structural analysis in the depth direction by fullerene ion sputtering shown in FIG. 3 is provided with a fullerene ion sputtering mechanism 4 capable of sputtering fullerene ions as sputtered ions. Namely, the apparatus is provided with both the ion sputtering mechanism 4 capable of sputtering fullerene ions and the ion bombardment mechanism 2 capable of bombarding with primary ions.

Like in FIG. 1, in FIG. 3, an ion bombardment mechanism capable of bombarding with cluster ions of gold or bismuth as primary ions, and an ion bombardment mechanism capable of bombarding with monomer ions of gold, bismuth, gallium, indium, or germanium are provided or changed from one to the other to provide the mechanism 2 capable of bombarding a surface of a test sample with the primary ions. The secondary ions produced from the surface of the test sample by primary ion bombardment are accelerated by an extraction electrode (not shown), and the times of flight are measured by a detector 3. The detector 3 is a time-of-flight secondary ion mass spectrometer. General-purpose apparatuses used as the detector include a sector type detector and a reflectron type detector. Any type of detector may be used.

Procedures of analysis in the depth direction from a surface using the apparatus shown in FIG. 3 will be described.

First, a surface of a test sample 1 is sputtered with fullerene ions from the fullerene ion sputtering mechanism 4. The surface of the sample 1 is sputtered by fullerene ions. The sputtering time is controlled to expose a surface of the sample at a desired depth.

Next, the sputtered surface of the test sample 1 is bombarded with cluster ions of gold or bismuth from the cluster ion bombardment mechanism 2, and a mass spectrum of secondary ions ionized at the outermost surface of the sample is measured.

Further, the ion source of the cluster ion bombardment mechanism 2 is changed, and the sputtered surface of the test sample 1 is bombarded with monomer ions of gold, bismuth, gallium, indium, or germanium. A mass spectrum of secondary ions ionized into the outermost surface of the sample is measured by the detector 3.

The order of ion bombardment of the sample surface may be reversed so that the surface is first bombarded with monomer ions and then bombarded with cluster ions. However, when the sample is significantly damaged, the ion bombardment position is shifted or the bombardment time is reduced.

After the completion of measurement, the resultant two or more mass spectra are subjected to data analysis on the basis of bombardment ion sizes in the information processor 6.

The data analysis on the basis of bombardment ion sizes can be performed on the basis of the fact that as the bombardment ion size increases, the mass number of secondary ions ionized increases and the bombardment ions less impact into the sample 1 from the outermost surface.

When the measurement surface of the sample 1 is composed of large molecules, the large molecules (with a high mass number) constituting the measurement surface of the sample 1 can be more sensitively detected by larger bombardment ions. In other words, a mass spectrum to be measured depends on the bombardment ion size. Therefore, consideration is given to variation in mass spectra according to the bombardment ion sizes so that the size of molecules constituting a surface can be analyzed.

The approach depth from a sample surface varies depending on the bombardment ion size, and when a mass spectrum varies depending on the bombardment ion size, it can be analyzed that a substance different from an internal substance forms a thin layer structure in a surface of the sample.

Figure 4A:
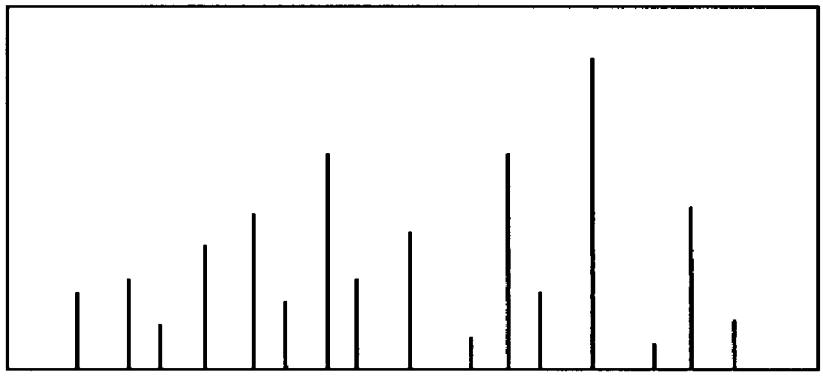
FIGS. 4A to 4C are graphs showing examples of measured mass spectra.
Figure 4B:
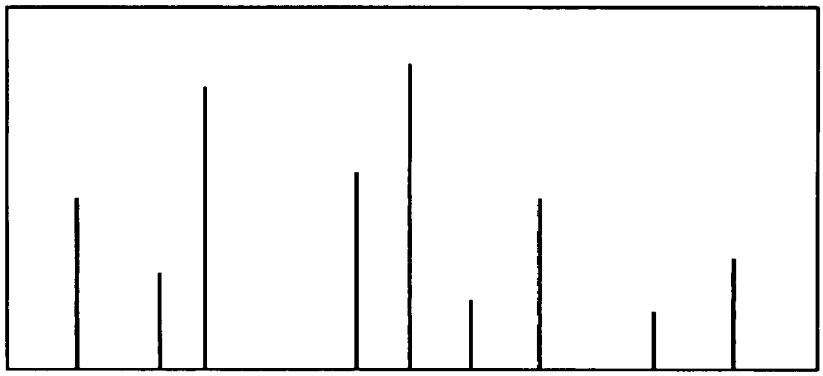
Figure 4C:
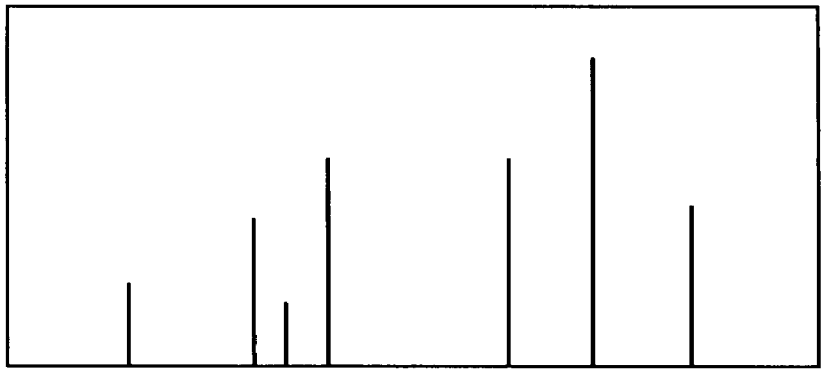

By using the above-described method of structural analysis of a measurement surface, it is possible to evaluate the degree of fullerene contamination in fullerene ion sputtering as shown in FIG. 4C. FIG. 4A shows the measured mass spectra from cluster ion bombardment; and FIG. 4B shows the measured mass spectra from monomer ion bombardment.

The method of structural analysis in the depth direction by fullerene ion sputtering of the present invention is not limited to a data analysis method based on bombardment ion sizes as shown in examples which will be described below. Peaks in a spectrum may be differentiated or integrated or peculiar functional processing may be performed. The structural analysis is not limited to a specified arithmetic processing and analysis method as long as data analysis enables comparison between spectra measured by bombardment ions.

Third Embodiment

In the present invention, a sample 1 can be sputtered with fullerene ions while being cooled to analyze a structure in the depth direction.

Figure 5:
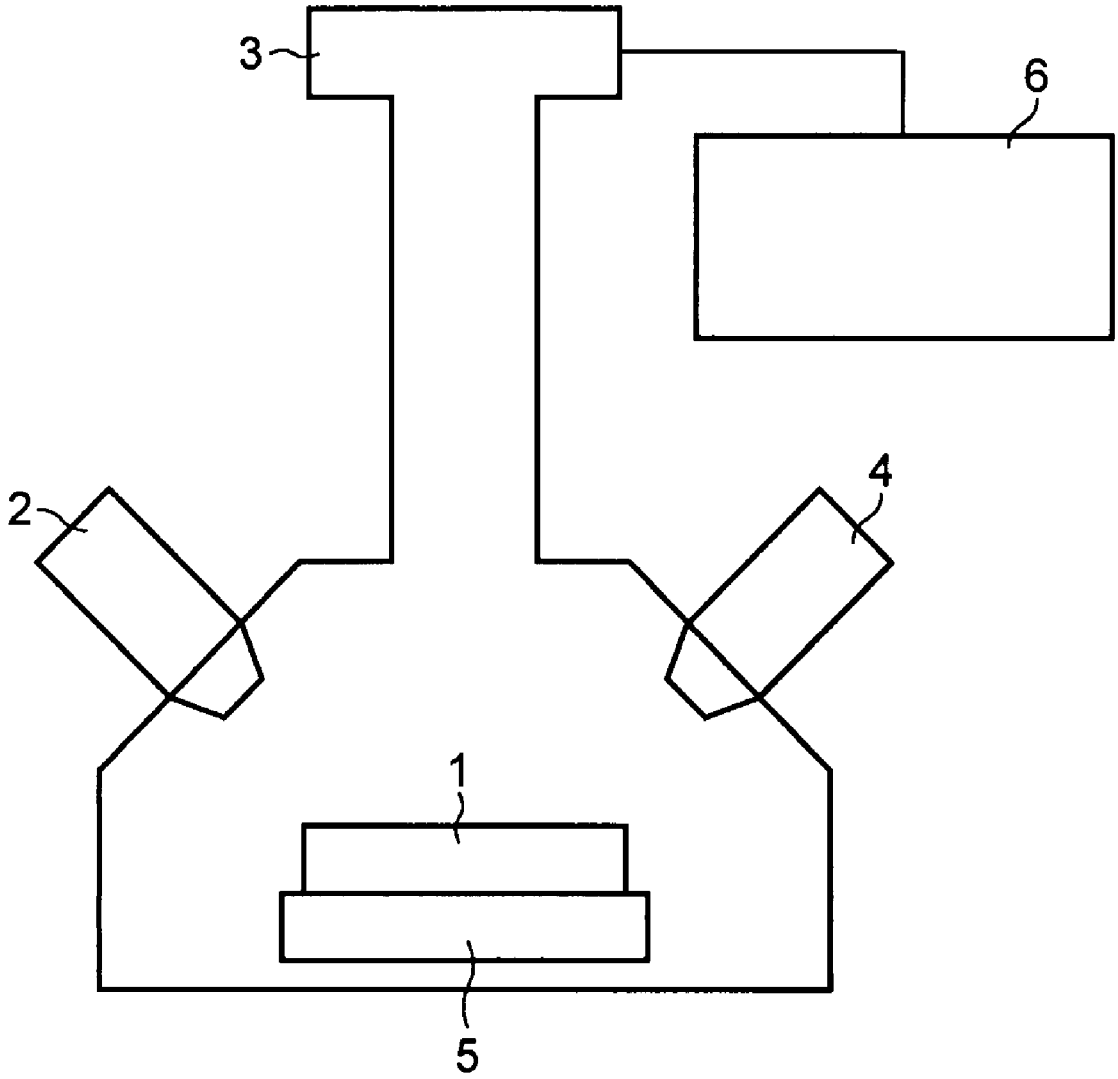
FIG. 5 is a drawing showing a surface structural analysis apparatus according to a third embodiment of the present invention.

FIG. 5 is a schematic drawing showing a time-of-flight secondary ion mass spectrometer provided with a cooling mechanism according to a third embodiment of the present invention.

In addition to the constitution shown in FIG. 3, the apparatus shown in FIG. 5 is provided with a mechanism 5 for cooling a measurement sample with liquid nitrogen. Since the other components are the same as in FIG. 3, the components are denoted by the same reference numerals.

The cooling mechanism 5 is adapted for cooling a measurement sample 1 by heat conduction from liquid nitrogen. The cooling temperature is preferably −100° C. or less, and the cooling atmosphere is preferably a vacuum atmosphere or an atmosphere at a low moisture pressure. When the cooling temperature is −100° C. or more, some liquid components or volatile components to be measured may move or evaporate during measurement. In a cooling atmosphere at a high moisture pressure, ice may adhere to the measurement sample due to dew condensation. Therefore, the cooling atmosphere is preferably a vacuum atmosphere or an atmosphere replaced by an inert gas such as nitrogen gas or argon gas.

A surface of the cooled measurement sample 1 is sputtered with fullerene ions from the fullerene ion sputtering mechanism 4 to expose a sputtered surface at a desired depth.

The sputtered surface of the measurement sample 1 is bombarded with cluster ions of gold or bismuth from the primary ion bombardment mechanism 2 to measure a mass spectrum of secondary ions ionized in the surface of the sample.

Further, the sputtered surface is bombarded with monomer ions of any one of gold, bismuth, gallium, indium, and germanium to measure a mass spectrum of secondary ions ionized in the surface of the sample.

The order of ion bombardment of the sputtered surface of the sample may be reversed so that the surface is first bombarded with monomer ions and then bombarded with cluster ions. However, when the sample is significantly damaged, the ion bombardment position can be shifted or the bombardment time can be reduced.

The resultant two or more mass spectra are subjected to data analysis on the basis of bombardment ion sizes in the information processing mechanism of the apparatus of structural analysis in the depth direction by fullerene ion sputtering of the present invention shown in FIG. 5. The analysis method is as described above.

EXAMPLES

Example 1

The surface analysis method and the surface measuring apparatus of the present invention will be described with reference to an example of application to a sample.

An aqueous solution of a styrene-acrylate copolymer having a surface-active function was adhered to an epoxy resin surface provided with water repellency by fluorocarbon treatment and then dried by nitrogen gas spraying to prepare a sample. The sample was measured and analyzed by time-of-flight secondary ion mass spectrometer TRIFT III manufactured by ULVAC-PHI. The type of primary ion bombardment was changed by replacing a filament of a primary ion gun (not shown) of the ion source 2 and changing an electric circuit of a primary ion bombardment control electrode (not shown). The acceleration voltage was 15 kV in $Ga^+$ ion bombardment and 22 kV in $Au^+$ ion bombardment and $Au_3^+$ ion bombardment.

First, a mass spectrum of secondary ions produced by $Ga^+$ ion bombardment was measured, and next a mass spectrum of secondary ions produced by $Au^+$ ion bombardment was measured. Finally, a mass spectrum of secondary ions produced by $Au_3^+$ ion bombardment was measured.

Figure 6A:
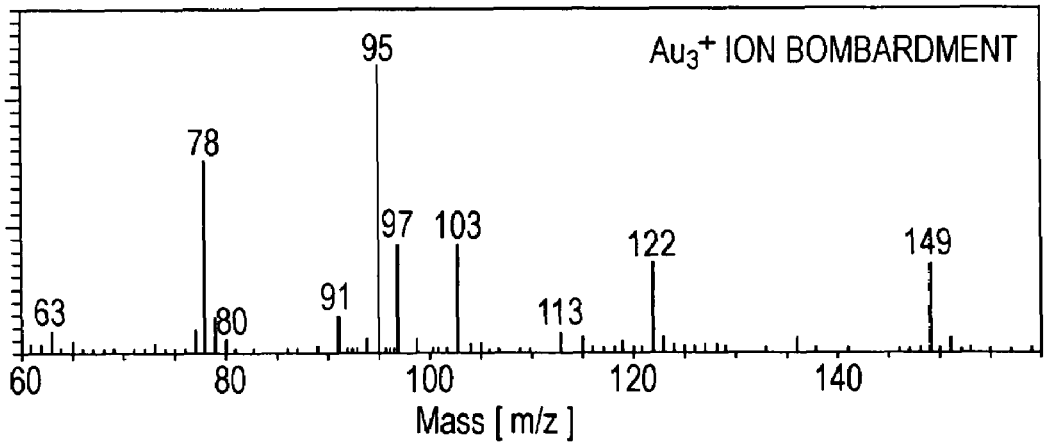
FIGS. 6A to 6C are graphs showing mass spectra measured in Example 1.
Figure 6B:
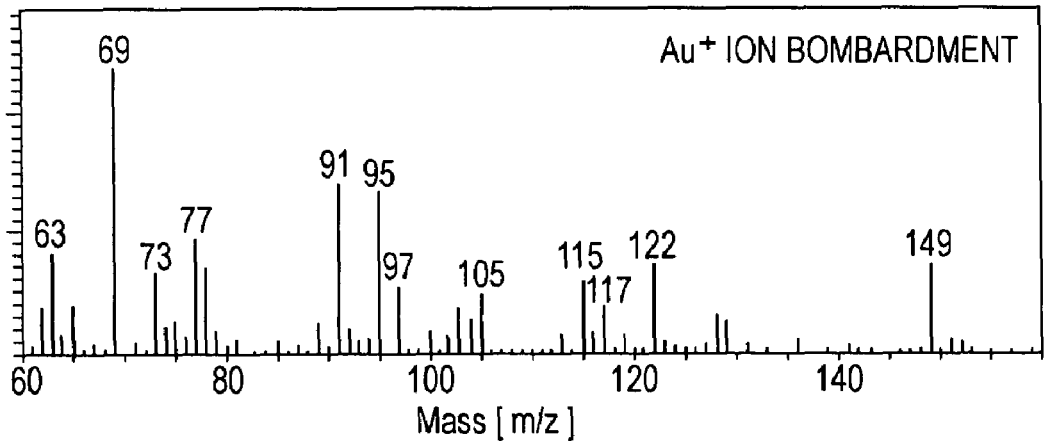
Figure 6C:
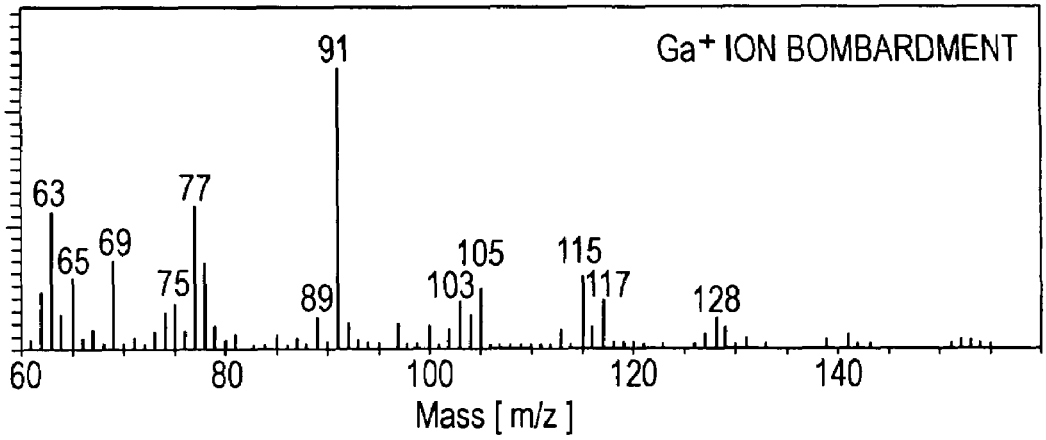

The obtained three mass spectra are shown in FIGS. 6A, 6B, and 6C. FIGS. 6A, 6B, and 6C show the measurement results of $Au_3^+$ ion bombardment, $Au^+$ ion bombardment, and $Ga^+$ ion bombardment, respectively.

Then, the following differential spectra were determined from the spectra shown in FIGS. 6A to 6C.

(Spectrum of $Au_3^+$ ion bombardment)−(Spectrum of $Au^+$ ion bombardment)

(Spectrum of $Au^+$ ion bombardment)−(Spectrum of $Ga^+$ ion bombardment)

Figure 7A:
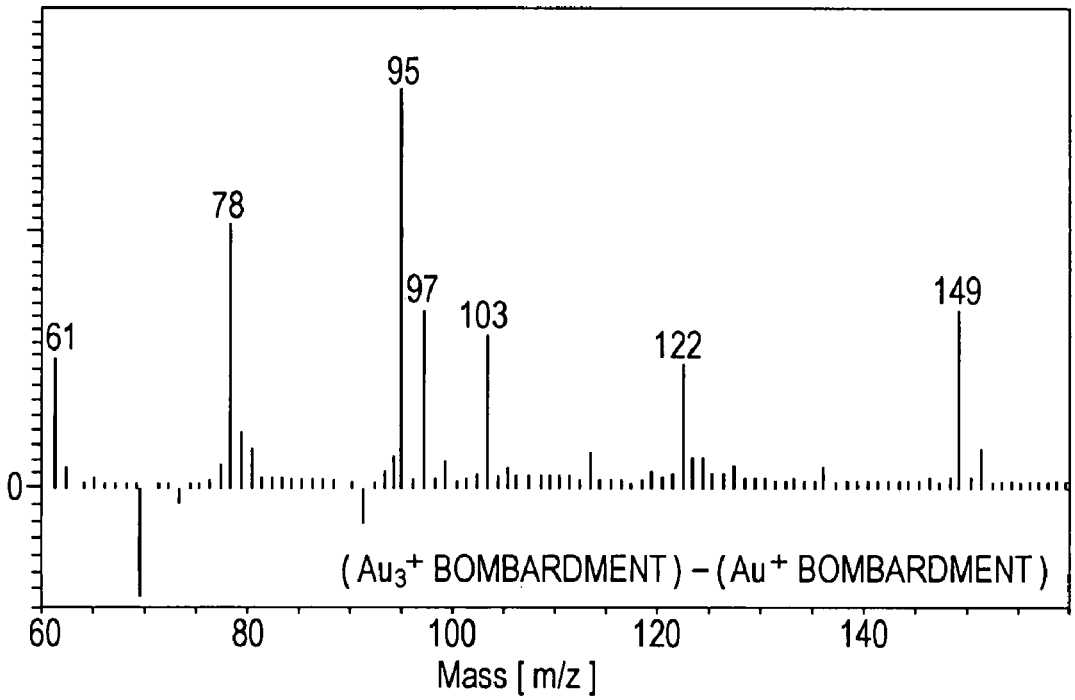
FIGS. 7A and 7B are graphs showing differences between the mass spectra shown in FIGS. 6A to 6C.
Figure 7B:
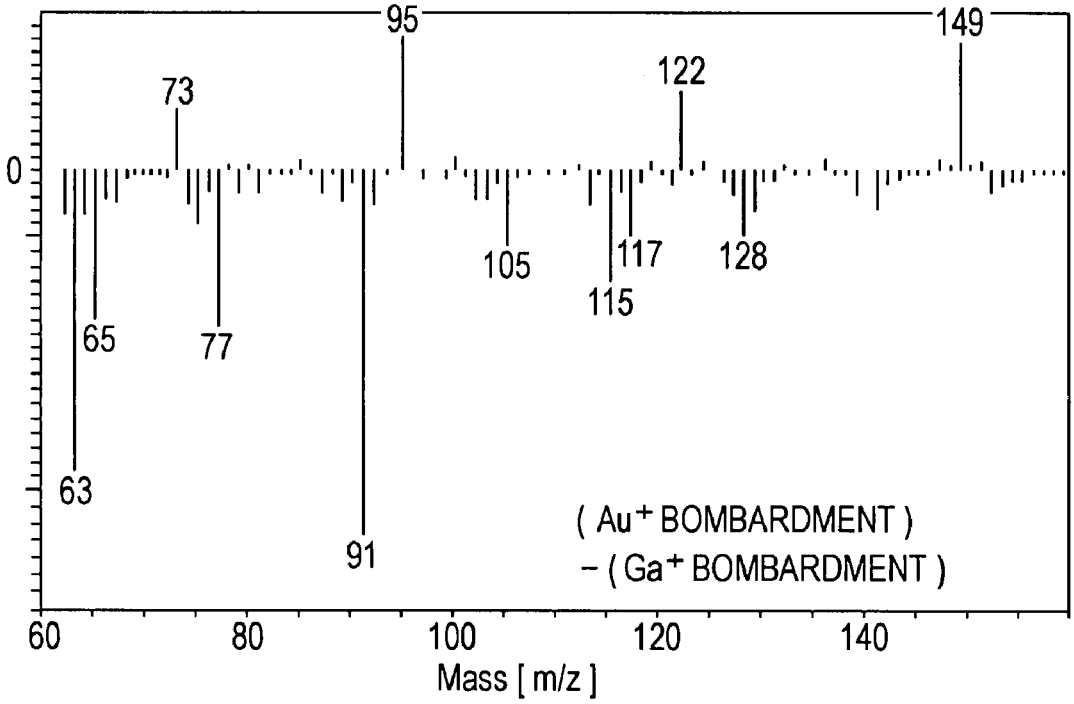

The resultant differential spectra are shown in FIGS. 7A and 7B.

Surface structural analysis by the spectra shown in FIGS. 7A and 7B will be described.

Among the spectral peaks detected in the spectra shown in FIGS. 6A to 6C, the peaks at Mass=78, 95, 103, 122, and 149 result from acrylate (potassium salt) of the styrene-acrylate copolymer, and the peaks at Mass=91 and 115 result from styrene of the styrene-acrylate copolymer.

A differential spectrum of ($Au_3^+$ ion bombardment)−($Au^+$ ion bombardment) indicates that the peaks at Mass=78, 95, 103, 122, and 149 have high intensity on the side (plus side) above the 0 level.

Next, a differential spectrum of ($Au^+$ ion bombardment)−($Ga^+$ ion bombardment) indicates that the peaks at Mass=95, 122, and 149 have high intensity on the side (plus side) above the 0 level, and the peaks at Mass=91 and 115 have high intensity on the side (minus side) below the 0 level.

Considering the above-mentioned results and the fact that primary bombardment ions less impact into the sample from the outermost surface as the size of the bombardment ions increases in the order of $Ga^+$, $Au^+$, and $Au_3^+$, it is analyzed that the acrylate moiety of the styrene-acrylate copolymer is mainly present in the outermost surface, and the styrene moiety of the styrene-acrylate copolymer is mainly present in the epoxy resin surface treated with fluorocarbon. Namely, it is analyzed that there is formed a molecular level layer structure (like an oriented structure) in which the styrene moiety of the styrene-acrylate copolymer adheres to the fluorocarbon-treated epoxy resin surface, and the acrylate moiety of the styrene-acrylate copolymer appears in the outermost surface.

Comparative Example

When, in an example, analysis is performed by only a mass spectrum obtained by each of the primary ion bombardments, the analysis can lead to the *** analysis result. For example, most of the peaks resulting from the acrylate moiety of the styrene-acrylate copolymer are not detected in a spectrum obtained by $Ga^+$ ion bombardment. This leads to the wrong analysis result that the acrylate moiety of the styrene-acrylate copolymer is absent from the surface.

Also, the peaks resulting from the styrene moiety of the styrene-acrylate copolymer and the peaks resulting from the acrylate moiety are mixed and detected only in a spectrum obtained by Au+ ion bombardment. This leads to the wrong analysis result that the styrene-acrylate copolymer is randomly present in the surface.

Further, most of the peaks resulting from the styrene moiety of the styrene-acrylate copolymer are not detected in a spectrum obtained by $Au_3^+$ ion bombardment. This may lead to the correct analysis result that the surface is covered with the acrylate moiety of the styrene-acrylate copolymer. However, the amount (layer thickness) of the acrylate moiety covering is unknown from the analysis result.

As described above, clear and accurate analysis results cannot be obtained by a mass spectrum measured by each of the primary ion bombardments.

Example 2

An example of the method and apparatus for structural analysis in the depth direction by fullerene ion sputtering of the present invention will be described on the basis of FIG. 3.

A silicon releasing agent was adhered to an epoxy resin surface provided with water repellency by fluorocarbon treatment to prepare a sample 1. The sample 1 was sputtered by fullerene ion sputtering apparatus 06-C60 (4) manufactured by ULVAC-PHI and then analyzed with respect to a structure in the depth direction by time-of-flight secondary ion mass spectrometer TRIFT III (3) manufactured by ULVAC-PHI. The type of primary ion bombardment was changed by replacing a filament of a primary ion gun (not shown) of the cluster ion source 2 and changing an electric circuit of a primary ion bombardment control electrode.

First, a mass spectrum of secondary ions produced by $Ga^+$ ion bombardment was measured, and next a mass spectrum of secondary ions produced by $Au^+$ ion bombardment was measured. Finally, a mass spectrum of secondary ions produced by $Au_3^+$ ion bombardment was measured.

The peak at Mass=91 assigned to an aromatic ring possibly resulting from a fullerene contamination was mainly detected in a surface layer of the sputtered surface of the sample. It was thus confirmed that the sputtered surface of the sample is contaminated by the fullerene.

Considering the fact that primary bombardment ions less impact into the sample from the outermost surface as the size of the irradiating ions increases in the order of $Ga^+$, $Au^+$, and $Au_3^+$, molecular structural analysis of the surface layer of the sputtered surface of the sample was performed on the basis of the fullerene ion irradiation time with attention to the peak at Mass=69 resulting from fluorocarbon and the peak at Mass=73 resulting from the silicon releasing agent. As a result, it was confirmed that the silicon releasing agent adhering to the surface of the sample is sputtered by fullerene ion to expose the fluorocarbon-treated surface on the sputtered surface without fracture.

The above-mentioned method and apparatus for structural analysis in the depth direction by fullerene ion sputtering permit analysis of a molecular structure in the depth direction of a molecular compound such as an organic compound or a silicon compound.

Example 3

An example of structure analysis of a cooled sample in the depth direction by fullerene ion sputtering will be described with reference to FIG. 5.

Luster paper printed by an ink jet printer was used as a measurement sample and analyzed with respect to the structure in the depth direction using time-of-flight secondary ion mass spectrometer TRIFT V nanoTOF manufactured by ULVAC-PHI.

First, a measurement chamber was replaced with nitrogen gas, and the measurement sample was cooled to −120° C. by a cooling stage 5 due to heat conduction of liquid nitrogen.

Then, the sample was bombarded with primary ions from the cluster ion bombardment mechanism 2 using a Ga ion gun and an Au ion gun as a primary ion gun, and mass spectra of the surface of the measurement sample were measured.

Then, the surface of the sample was sputtered by fullerene ions using a fullerene ion gun of the fullerene ion sputtering mechanism 4. The sputtered surface was further bombarded with primary ions using a Ga ion gun and an Au ion gun as a primary ion gun, and mass spectra were measured. This measurement cycle was repeated to analyze the structure of the measurement sample in the depth direction.

In one time of mass spectral measurement, the sample was bombarded with primary ions of different ion sizes as follows: First, a mass spectrum of secondary ions produced by $Ga^+$ ion bombardment was measured, and next a mass spectrum of secondary ions produced by $Au^+$ ion bombardment was measured. Finally, a mass spectrum of secondary ions produced by $Au_3^+$ ion bombardment was measured.

Peaks assigned to an aromatic ring possibly resulting from a fullerene contamination were mainly detected in a surface layer of the sputtered surface of the sample. It was thus confirmed that the sputtered surface of the sample is contaminated by the fullerene.

Considering the fact that primary bombardment ions less impact into the sample from the outermost surface as the size of the bombardment ions increases in the order of $Ga^+$, $Au^+$, and $Au_3^+$, molecular structural analysis of the measurement sample in the depth direction was performed by fullerene ion sputtering with attention to the peaks resulting from water used as an ink solvent for printing and the peaks resulting from an ink dye. As a result, it was confirmed that the ink solvent is three-dimensionally distributed around the ink dye in a print portion of the luster paper.

The above-mentioned method and apparatus for structural analysis of a cooled sample in the depth direction by fullerene ion sputtering permit analysis of a molecular structure in the depth direction of a molecular compound such as an organic compound, which contains a liquid component and a volatile component, or a silicon compound and analysis of a distribution of components.

Example 4

The same measurement sample 1 as in Example 3 was cooled to −90° C. by the cooling stage 5 due to heat conduction of liquid nitrogen and measured by the same method as in Example 1.

As a result of analysis, the peaks resulting from water used as an ink solvent were not easily detected, and thus it was impossible to obtain the same data as in Example 3 that the ink solvent is three-dimensionally distributed around the ink dye in a print portion of the luster paper.

It was thus found from comparison to Example 3 that the cooling temperature of a sample is preferably −100° C. or less.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-179815 filed Jun. 29, 2006 and No. 2007-107173 filed Apr. 16, 2007, which are hereby incorporated by reference herein in their entirety.

What is claimed is:

1. A surface analysis apparatus comprising:

a unit configured to bombard a sample surface with an ion;

a measurement device for measuring, with a time-of-flight secondary ion mass spectrometer, at least two mass spectra of ions emitted from the sample surface, wherein the at least two mass spectra correspond, respectively, to at least two types of ions having different sizes; and an information processor outputting a difference between the at least two mass spectra measured by the measurement device.

2. The surface analysis apparatus according to claim 1, wherein one of the at least two types of ions is monomer ions, and another of the at least two types of ions is dimer or higher-order cluster ions.

3. The surface analysis apparatus according to claim 2, wherein the cluster ions are gold or bismuth ions.

4. The surface analysis apparatus according to claim 2, wherein the monomer ions are gold, bismuth, gallium, gennanium, or indium ions.

5. The surface analysis apparatus according to claim 1, wherein the number of types of ions is 3 or more, and the information processor outputs differences between adjacent mass spectra in order of ion sizes.

6. The surface analysis apparatus according to claim 1, wherein the apparatus is configured to determine the molecular structure or elemental composition in the depth direction for the sample outermost surface from the difference between the at least two mass spectra measured by the measurement device.

7. The surface analysis apparatus according to claim 1, further comprising a unit configured to sputter the sample with fullerene ions.

8. The surface analysis apparatus according to claim 1, further comprising a unit configured to cool the sample.

9. The surface analysis apparatus according to claim 8, wherein the unit configured to cool the sample is configured to cool the sample at a cooling temperature of −100° C. or less.

10. A surface analysis method comprising the steps of:

A: sputtering a sample surface with fullerene ions;

B: bombarding the sample surface with an ion;

C: measuring at least two mass spectra of ions emitted from the sample surface with a time-of-flight secondary ion mass spectrometer, wherein the at least two mass spectra correspond, respectively, to the at least two types of ions having different sizes; and D: outputting a difference between the at least two mass spectra measured in step C;

wherein the step D is performed after the steps A to C are repeated a plurality of times.

11. A surface analysis apparatus comprising:

a unit configured to bombard a sample surface with an ion;

a measurement device for measuring, with a time-of-flight secondary ion mass spectrometer, at least two mass spectra of ions emitted from the sample surface, wherein the at least two mass spectra correspond, respectively, to a gold ion and a gallium ion; and an information processor outputting a difference between the at least two mass spectra measured by the measurement device.

12. An apparatus comprising:

a measurement device for measuring, with a time-of-flight secondary ion mass spectrometer, at least two mass spectra of ions emitted from the sample surface, wherein the at least two mass spectra correspond, respectively, to two types of ions having different sizes; and an information processor outputting a difference between the at least two mass spectra measured by the measurement device to get information on a molecule distribution depending on the depth of the sample.

* * * * *